US008844503B2

(12) United States Patent
Worthington et al.

(10) Patent No.: US 8,844,503 B2
(45) Date of Patent: Sep. 30, 2014

(54) VARIABLE FLOW FUEL TRANSFER PUMP SYSTEM AND METHOD

(75) Inventors: Joseph A. Worthington, Greenwood, IN (US); Norman C. Blizard, Columbus, IN (US); David P. Genter, Columbus, IN (US); Gregory S. Franks, Edinburgh, IN (US); Michael F. Mattern, Columbus, IN (US); Thomas O. Hahn, Columbus, IN (US); James L. Walls, Cookeville, TN (US); Edward N. Linen, Columbus, IN (US)

(73) Assignee: Cummins Intellectual Property, Inc., Minneapolis, MA (US)

( * ) Notice: Subject to any disclaimer, the term of this patent is extended or adjusted under 35 U.S.C. 154(b) by 221 days.

(21) Appl. No.: 13/243,518

(22) Filed: Sep. 23, 2011

(65) Prior Publication Data

US 2012/0073545 A1 Mar. 29, 2012

Related U.S. Application Data

(60) Provisional application No. 61/385,588, filed on Sep. 23, 2010.

(51) Int. Cl.
*F02M 37/08* (2006.01)
*F02M 37/22* (2006.01)

(52) U.S. Cl.
CPC ..... *F02M 37/22* (2013.01)
USPC ..... 123/497; 123/446; 123/457

(58) Field of Classification Search
USPC ..... 123/446, 457, 458, 497, 510, 511
See application file for complete search history.

(56) References Cited

U.S. PATENT DOCUMENTS

| | | | | |
|---|---|---|---|---|
| 5,505,180 | A * | 4/1996 | Otterman et al. | 123/497 |
| 5,507,266 | A | 4/1996 | Wright et al. | |
| 6,581,574 | B1 | 6/2003 | Moran et al. | |
| 6,609,500 | B2 | 8/2003 | Ricco et al. | |
| 6,715,470 | B2 * | 4/2004 | Takahashi | 123/458 |
| 7,066,149 | B1 * | 6/2006 | Date et al. | 123/457 |
| 7,284,539 | B1 * | 10/2007 | Fukasawa et al. | 123/506 |
| 7,299,790 | B2 | 11/2007 | Okamoto et al. | |
| 7,774,125 | B2 | 8/2010 | Scharfenberg | |

(Continued)

FOREIGN PATENT DOCUMENTS

DE 10 2011 005 663 * 9/2012 ..... F02M 37/08

OTHER PUBLICATIONS

The International Search Report and the Written Opinion dated Apr. 16, 2012; International Application No. PCT/US11/53052.

*Primary Examiner* — Hai Huynh
(74) *Attorney, Agent, or Firm* — Faegre Baker Daniels LLP

(57) ABSTRACT

A fuel supply system and method of controlling fuel flow through a supply system is provided including a variable flow, i.e. speed, electric fuel transfer pump and a control system adapted to variably control the transfer pump based on fuel demand of the engine. The system provides improved transient response by providing the transfer pump with a feed forward speed/flow command based on engine fueling demand determined based on engine operating conditions. The transfer pump is controlled based on fuel demand not necessarily achieved yet by the high pressure pump and injectors. Therefore, this system controls the EFTP substantially simultaneously with controlling the high pressure pump and injectors to optimize fuel flow through the entire system ensuring the minimum required fuel flow is passing through the second the fuel filtration system, hence maximizing steady state fuel filtration efficiency, and minimizing surge effects on filtration efficiency.

20 Claims, 6 Drawing Sheets

(56) References Cited

U.S. PATENT DOCUMENTS

| | | | | |
|---|---|---|---|---|
| 8,205,596 | B2 * | 6/2012 | Kieferle et al. | 123/446 |
| 8,210,155 | B2 * | 7/2012 | Ohta et al. | 123/446 |
| 2004/0055575 | A1 | 3/2004 | McCarthy, Jr. et al. | |
| 2005/0199219 | A1 | 9/2005 | Utsumi | |
| 2006/0225709 | A1 | 10/2006 | Washeleski et al. | |
| 2008/0022973 | A1 * | 1/2008 | Puckett et al. | 123/446 |
| 2008/0035118 | A1 | 2/2008 | Toyohara et al. | |
| 2009/0187326 | A1 | 7/2009 | Rozman et al. | |
| 2010/0132670 | A1 | 6/2010 | Okamoto | |
| 2010/0139624 | A1 | 6/2010 | Surnilla et al. | |
| 2010/0274467 | A1 * | 10/2010 | Hayami | 701/103 |

* cited by examiner

VARIABLE FLOW FUEL TRANSFER PUMP SYSTEM AND METHOD

TECHNICAL FIELD

This disclosure relates to fuel systems for internal combustion engines, and, specifically, to controlling fuel flow through a fuel system.

DETAILED DESCRIPTION

Figure 1:
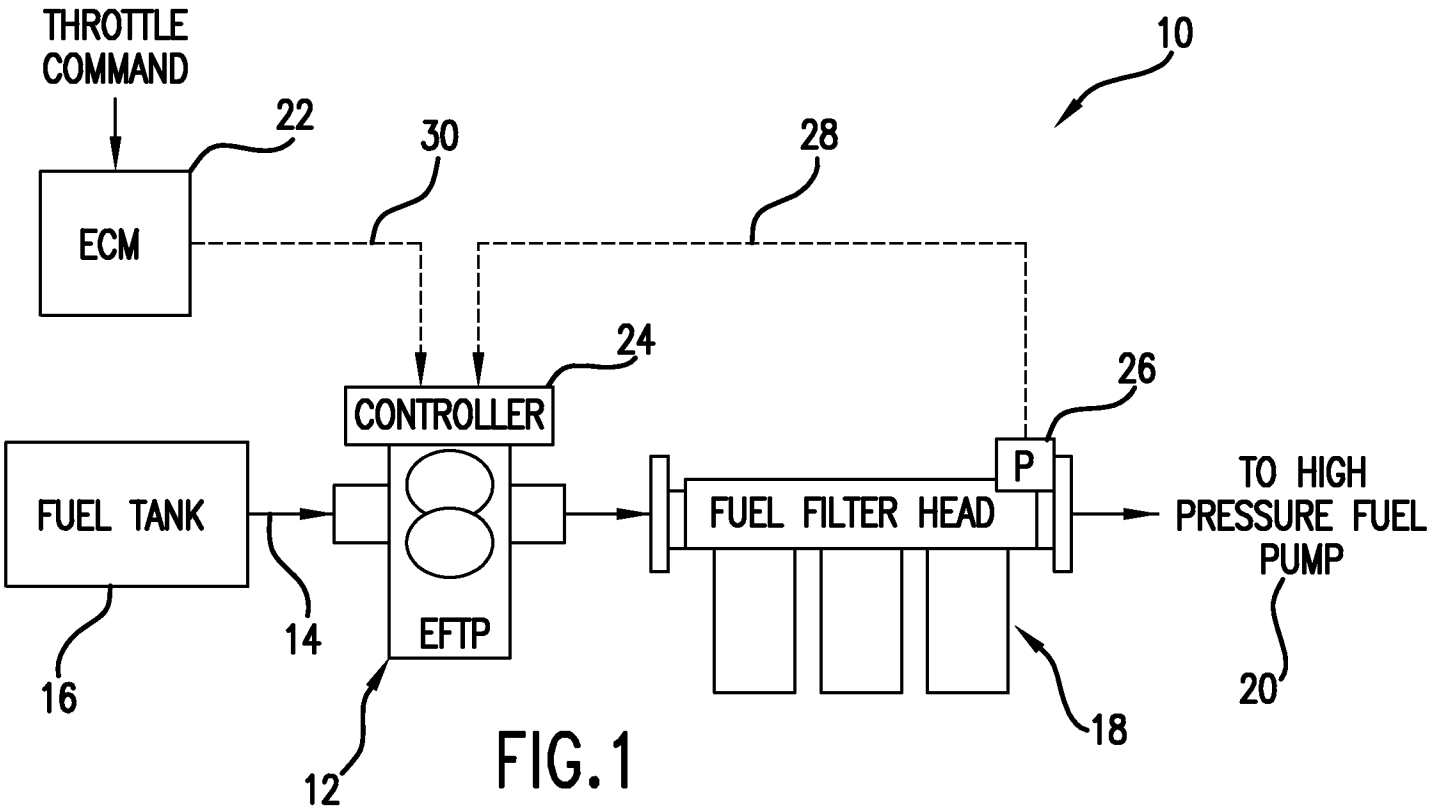
FIG. 1 is a schematic of a fuel system in accordance with an exemplary embodiment.

Applicant has recognized that by more closely matching the amount of fuel flowing through the fuel filtration system to the amount of fuel used or demanded by the engine to attain the required power (e.g. injected or burned fuel), an advantageous system and method can be provided. One important advantage is that the fuel filtration media has much greater potential to permanently remove particles and water droplets from the flow stream (e.g. improved filtration efficiency). Enhanced fuel filtration performance has been proven to be a key measure to protect the fuel injection system from premature wear and corrosion which leads to subsequent failure. As injection pressures increase over time, as anticipated in the near future in order to meet more stringent emissions and fuel consumption targets, fuel systems, including high pressure common rail fuel systems, will become even more sensitive to abrasive wear induced from very small hard particles that pass through the filtration system to the high pressure fuel system. Improving filtration performance over the life of the filter (e.g. even at end of life) will be necessary for attaining the fuel system reliability and durability targets required by engine providers and operators.

As fuel filters gather debris over time, depending on the filter media used, their performance worsens (known as efficiency degradation). This phenomenon is more prevalent for very small particles. It is worth noting that particles less than 2 microns in size may cause significant distress to high pressure common rail injection system hardware. Applicant has now recognized that the ability of the filter to retain the debris it captures is a direct function of fuel flow rate, and the rate of fuel flow rate change (known as flow surge) through the filtration system. As the fuel flow rate and flow surge levels per unit media area are reduced, the potential for the media to retain particles it at one time captures, is greatly improved.

Embodiments consistent with the present disclosure minimize both the flow rate and the flow surge effects through the fuel filtration system in order to maximize filtration efficiency over the life of the filter. Applicant's test data has repeatedly shown that filtering of very small particles does not necessarily occur by what is known as "sieving". "Sieving" occurs when a fluid is filtered and the incoming particles become trapped within the filtration media in "holes" (or pores) which are smaller than the particles themselves. Although sieving does occur for fuel filtration, it does not typically occur effectively when particle sizes get extremely small. To effectively sieve small particles from the flow stream, the media would need to be prohibitively "tight-pored" typically leading to very poor life from the filtration package (e.g. premature plugging) which is unacceptable to the engine customer. For small particles, the filter media removes many of them from the flow stream by particle adherence to the edge (or wall) of the media fibers. This is known as "interception". Hence, the "large" pores in the media (note that all media has a distribution of "large" and "small" pores within a given media pack) become lined with particles around the periphery of the pore. These small particles adhere to the fiber with a relatively weak force, and when flow conditions change across the media (e.g. flow surge) or when steady state flow velocities are "high", the particles are prone to detaching from the fibers and flowing downstream of the media. Reducing the face velocity (flow rate/media area) of the system by either adding more media, or reducing the flow rate, address the physics of the filtration challenge, and allow the fuel filtration media to better retain particles within its pore structure. However, these attempts to solve the issues are not typically cost or packaging-effective and/or are not practical with a mechanically-driven fuel transfer pump that is tied to engine speed, and an electrical non-variable flow fuel transfer pump.

The traditional system for transferring fuel from the tank to the high pressure pump, is to use a mechanically-driven (positive displacement) pump driven somewhere off the engine's gear train (e.g. often off the rear of the high pressure pump). If the fuel transfer pump is driven directly or indirectly off the engine's gear train, the pump's operation is tied to the speed of the engine. Since the pump is sized to provide enough fuel flow at low speeds to pressurize the high pressure pump sufficiently to start the engine, then at high speeds, the transfer pump is supplying much more flow than is required to power the engine. The excess fuel (often greater than ~60+% of the total flow) is recirculated through the system, often plumbing the recirculated fuel to the inlet of the fuel transfer pump. For this type of mechanically-driven fuel transfer pump system, full pump flow passes through the second stage of filtration. Note that first stage filters are typically provided upstream of a transfer pump while second stage filters are positioned downstream of the transfer pump but upstream of the high pressure pump. This additional fuel flow passing through the second stage filters makes it more difficult for the media to retain the particles once captured, especially those particles removed from the flow stream by interception.

Embodiments consistent with the systems and methods of the present disclosure enhance filter performance and life, and reduce engine system wear, by reducing the fuel flowing through the filters to only that required to meet the fuel injection pump needs including the fuel quantity injected and, if desired or required, any additional flow for cooling. The systems and methods disclosed herein allow variable flow through the system, reducing face velocity of the fuel flowing through the fuel filters, maximizing fuel filtration life, and reducing wear due to excessive fuel flow. The systems and methods also utilize an algorithm in the electronic control module to command the proper amount of fuel from a variable flow, electric fuel transfer pump that properly matches the fuel demand of the engine, i.e. the amount of fuel to be injected or used by the engine, and thus the amount of fuel to be pumped by a high pressure fuel injection pump, i.e. fuel flow rate, as commanded from the electronic control module or means (ECM).

As shown in FIG. 1, an exemplary embodiment of a system 10 and method of the present disclosure includes a variable flow, or speed, electric fuel transfer pump (EFTP) 12 positioned along a fuel supply circuit 14 to pump fuel from a fuel tank 16 to a high pressure pump 20 via at least one stage of fuel filtration, i.e. filter assembly 18. EFTP 12 includes a pump controller 24 adapted to receive various signals and control the operation of EFTP 12 to vary the flow of fuel delivered to high pressure pump 20. An electronic control unit or module (ECM) 22 monitors engine operating conditions such as engine load, throttle position, etc, determines engine fueling demand and generates a feed forward speed/flow command signal 30 based on engine fuel demand. Feed forward command signal 30 is sent to pump controller 24. Also a pressure sensor 26 is provided downstream of EFTP 12 and upstream of high pressure pump 20, preferably at the outlet of filter assembly 18, to detect the supply pressure of EFTP 12. A supply feedback pressure signal 28 is generated by pressure sensor 26 and received by pump controller 24. Pump controller 24 then uses feed forward speed/flow command signal 30 and supply feedback pressure signal 28 to variably control the flow from EFTP 12 to substantially match the fuel demand of the engine.

In the exemplary embodiment, EFTP 12 may be a variable speed pump including, for example, an electrically controlled variable speed motor for which the motor speed is controlled by varying the current to the motor. The system and method of the present disclosure may use another type of variable flow control so long as the control may be based on fuel demand of the engine. Thus EFTP 12 can be variably controlled independent of engine speed to selectively vary the fuel flow rate from the EFTP based on fuel demand of the engine and independent of engine speed throughout engine operation.

Figure 2:
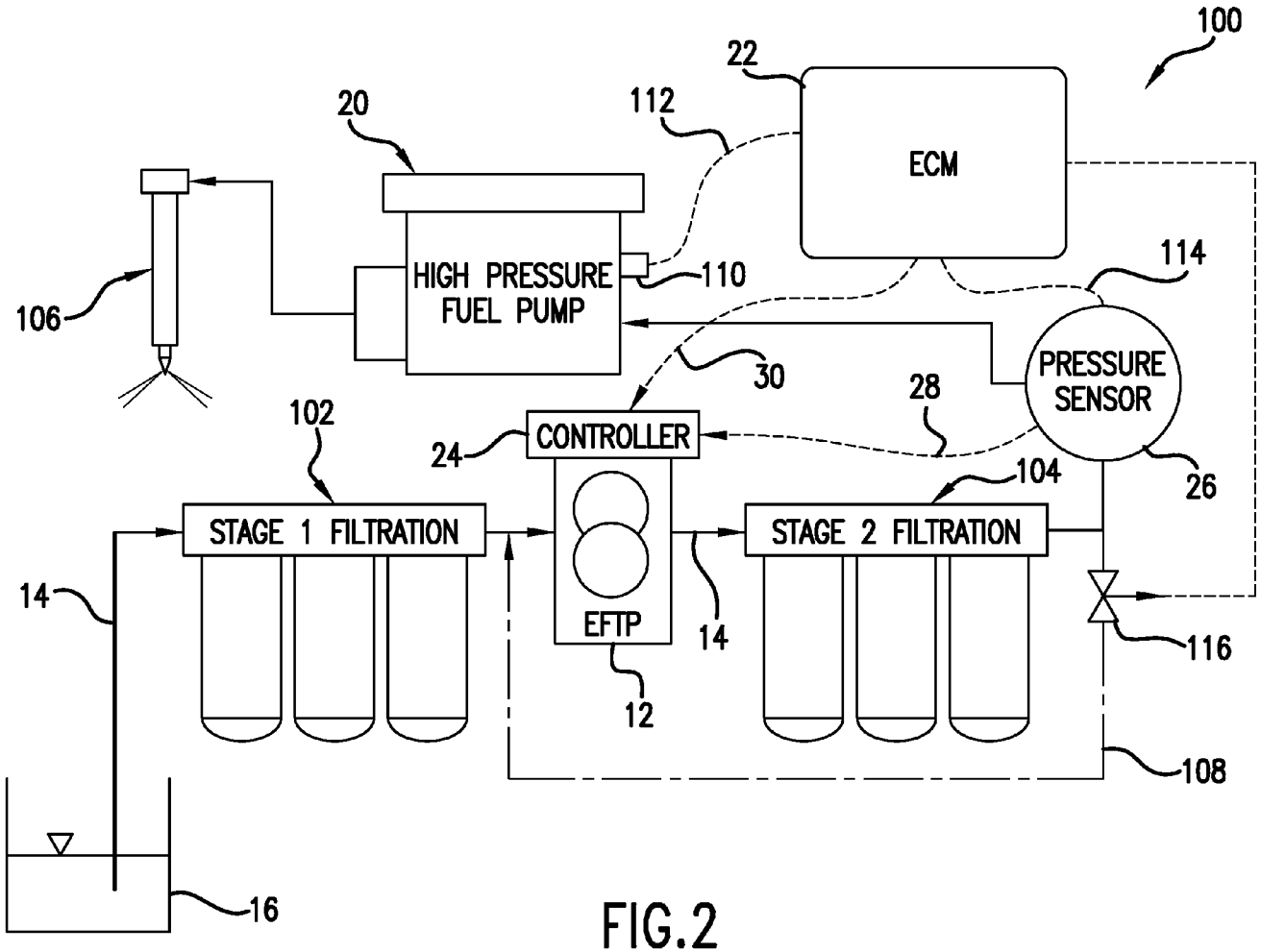
FIG. 2 is a schematic of another fuel system in accordance with a second exemplary embodiment.

FIG. 2 shows another exemplary embodiment similar to the embodiment of FIG. 1, wherein like or similar components are referred to with the same reference numerals. System 100 includes however both a first stage filter assembly 102 and a second stage fuel assembly 104. FIG. 2 also shows more details relating to the control of EFTP 12 and the use of a fuel injector 106 representing multiple fuel injectors in a typical engine. A high pressure sensor 110 is mounted at the outlet of high pressure pump 20, e.g. on a high pressure common rail, to detect the high pressure and provide a high pressure signal 112 to ECM 22. The high pressure signal 112, measuring actual pressure, is monitored by ECM 22. System 100 requires high pressure pump 20 to supply fuel to injectors 106, or a high pressure common rail, at a particular high pressure corresponding to a given set of engine operating conditions, such as throttle position, engine load, etc. ECM 22 determines the engine conditions at a given time and then determines, using for example a look-up table and/or appropriate algorithm, the corresponding fuel demand of the engine to be provided by the high pressure pump 20 and injectors 106. ECM 22 then determines the appropriate current value for controlling the speed of EFTP 12 based on the actual high pressure signal 112 and the determined engine fuel demand, and generates and sends a feed forward speed/flow command signal 30 to EFTP 12. In this feed forward closed loop mode, high pressure signal 112 and feed forward speed/flow command signal 30 are used by EFTP controller 24 to variably control the speed of EFTP 12 to vary the fuel flow to provide, i.e., match, the flow required by high pressure pump 20 to achieve the desired high pressure value without providing additional flow (except perhaps a small recirculation flow as discussed hereinbelow). In this manner, the transfer fuel flow from EFTP 12 is limited to only that amount necessary to meet the fueling demand of the engine without providing excess fuel flow thereby optimizing fuel flow through the filter assemblies. A pressure signal 114 may be fed from pressure sensor 26 to ECM 12 for diagnostic use. The system may be operated in other modes as described hereinbelow relative to FIG. 3.

A recirculation line 108 may be connected at one end to the primary fuel supply circuit 14 downstream of high pressure pump 20 and at an opposite end to supply circuit 14 upstream of variable speed EFTP 12. One or more recirculation lines permit fuel system precleaning, for example, after a filter change or when initially using fuel of suspect, unknown, or poor quality. A valve 116, for example, in the recirculation line, may be used to control recirculation flow. The EFTP 12 running cycle recirculates fuel through filtration for some period of time to pass the fuel through the filters multiple times for additional cleaning. This method and system permits the operator to clean fuel to a desired level without additional pre-filtration being added. This approach may prevent start-up contamination spikes and premature injector and pump wear.

It should be noted that although some level of fuel recirculation back to the inlet of EFTP 12 to account for flow required to cool EFTP 12, to deaerate the fuel system (similar to the mechanical pump, but with much less flow), or to provide fuel cleaning capability, recirculation back to the inlet of the pump may not be provided in other embodiments. Alternatively, or additionally, a small low flow air bleed circuit connected at one end, for example, immediately downstream of the second stage filter assembly 104, and at a second end to a low pressure drain, may be provided to bleed air from the system.

Figure 3:
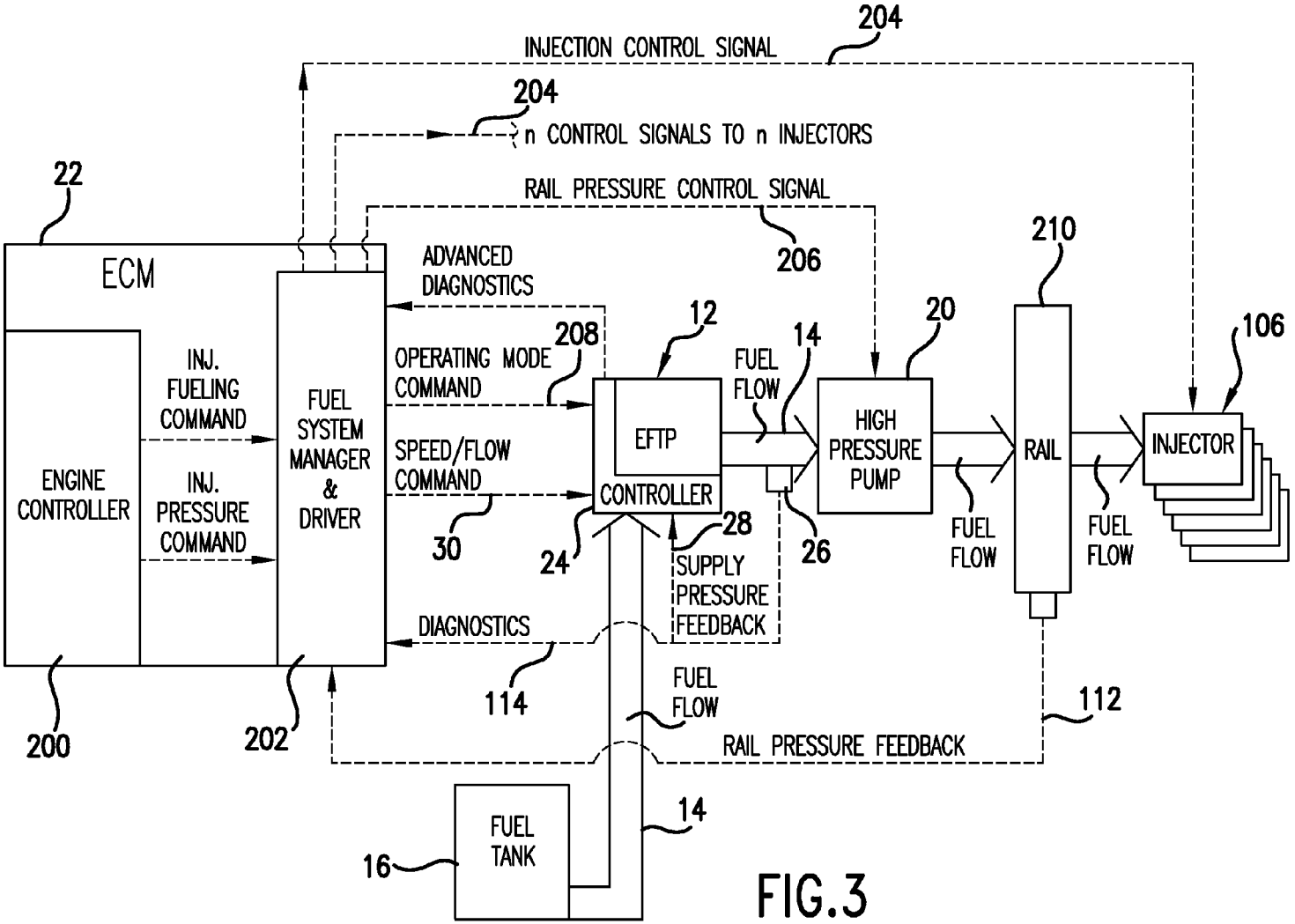
FIG. 3 is a more detailed schematic of the control system used in the fuel systems of FIGS. 1 and 2.

FIG. 3 shows additional details of an exemplary embodiment of the control system and method for controlling EFTP 12. ECM 22 includes an engine controller module 200 adapted to monitor or receive engine operating conditions, such as operator throttle command, engine load, etc, and generate injection fueling and injection pressure commands. ECM 22 also includes a fuel system manager & driver module 202 that receives the injection fueling command and injection pressure command (based on operator throttle command, engine load, etc.) from engine controller module 200. Fuel system manager and driver 202 also receives feedback pressure signal 112 providing actual fuel rail pressure data. Fuel system manager & driver module 202 uses these inputs (injection fueling and injection pressure commands, and feedback pressure signal 112) and then generates and sends an injection control signal 204 to injectors 106, and a rail pressure control signal 206 to high pressure fuel pump 20, to control the fuel rail pressure and fuel injection events. Injection control signals 204 control respective injectors 106 by, for example, controlling an actuator and valve mounted on each injector to control the amount of fuel injected. Rail pressure control signal 206 is used to control the amount of high pressure fuel delivered by the high pressure pump thereby controlling the fuel pressure in one or more high pressure reservoirs, i.e., common rail 210, providing fuel to the injectors. Thus, for example, an increase in engine load requiring more fuel to be injected into engine combustion chambers, may require adjustments/changes in the injection fuel command and control signals to cause the injection of more fuel, and adjustments or changes in the injection pressure command and pressure control signal to cause high pressure pump 20 to increase the high pressure pump flow rate. This control loop closes the loop on priming using the ECM and permits better closed loop control without a supply pressure sensor.

As shown in FIG. 3, an EFTP control system and method is also provided which includes "feed-forward" control including an operating mode command signal 208 and the feed forward speed/flow command signal 30. Fuel system manager & driver module 202 varies the feed forward speed/flow command 30 based on changes to the injection pressure command or rail pressure control signal, and/or changes to the injection fueling command or injection control signals. Fuel system manager & driver module 202 sets the operating mode command 208 to instruct EFTP controller 24 to run in one of at least two operating modes. As noted in the previous embodiments, an inner loop provides supply pressure feedback signal 28 from downstream pressure sensor 26 to the EFTP controller 24 on EFTP 12 itself. With respect to operating modes, in one exemplary embodiment, for example, EFTP controller 24 may run in one of three modes: 1) Supply pressure closed loop mode to maintain constant pressure based only on supply pressure feedback signal 28, without use of feed forward speed/flow command signal 30; 2) Feed forward closed loop mode based on supply pressure feedback signal 28 and feed forward speed/flow command signal 30 to improve transient response; and 3) Feed forward open loop mode based only on feed forward speed/flow command signal 30 without use of supply pressure feedback signal 28 (useful for priming new fuel filters). In an alternative embodiment, only two modes may be provided for use, such as only the feed/forward closed loop mode and the feed forward open loop mode described above. In another exemplary embodiment, the feed-forward control does not include a mode control, but only includes the feed forward speed/flow command signal 30, and only the feed-forward closed-loop mode is available for use based on supply pressure feedback signal 28 and feed forward speed/flow command signal 30 to thereby control EFTP 12 to maintain improve transient response throughout engine operation, while no other modes are provided. In addition, EFTP 12 can provide diagnostic information back to the fuel system manager & driver 202. The ECM can then take appropriate action such as warning the operator, derating the engine, etc.

The benefits of this system include improved transient response since the ECM is providing the EFTP with a feed forward speed/flow command based on the injection fueling and pressure commands which in turn are based on engine load and thus fueling demand not necessarily achieved yet by the high pressure pump and injectors. Therefore, this system controls the EFTP substantially simultaneously with controlling the high pressure pump and injectors to optimize fuel flow through the entire system. That is, the injection fueling and pressure commands/signals are the commands used to target a desired target fuel injection amount, and a desired target rail pressure, both not yet necessarily achieved. By controlling EFTP 12 based on target values for fuel pressure/injection and thus fuel consumption, that is, fuel demand, the present system and method allows the EFTP controller to use fuel demand values representing the present or future fuel demand of the engine so that the EFTP varies the upstream low pressure flow rate to the high pressure pump to supply only the fuel demanded by the high pressure pump to reach the target high pressure value. That is, the EFTP is controlled in a manner to vary the low pressure supply flow rate in direct proportion to changes in the high pressure flow rate from high pressure pump 20 so that commanded increases in the high pressure flow rate also result in approximately simultaneous proportional increases in the low pressure flow rate from EFTP 12 and likewise commanded decreases in the high pressure flow rate result in approximately simultaneous proportional decreases in the low pressure flow rate. In the exemplary embodiment, the low pressure flow rate from EFTP 12 is controlled, based on engine fuel demand, to closely approximate or match the high pressure fuel rate, including any small additional recirculation flow as discussed herein. As discussed here, fuel demand of the engine means the flow rate of fuel required by high pressure pump 20 to achieve commanded rail pressure and/or the flow rate of fuel consumed by the engine, e.g., injected. One or more of various engine and fuel system commands, control signals, and/or target values, indicative of engine fuel demand, as discussed herein, may be used as the fuel demand parameter, or basis, for determining the control of EFTP 12 to vary or adjust the low pressure fuel flow rate. The system and method also enhances the ability to prime fuel filters without cranking the engine; improves diagnostics; avoids oversizing the transfer pump to get sufficient flow at low engine speed; and avoids bypassing or recirculating large quantities of fuel at high engine speed.

Although not shown in FIG. 3, it should be understood that the system and method of FIG. 3 may include either the single stage filter assembly of FIG. 1 or the two stage arrangement of FIG. 2.

Figure 4:
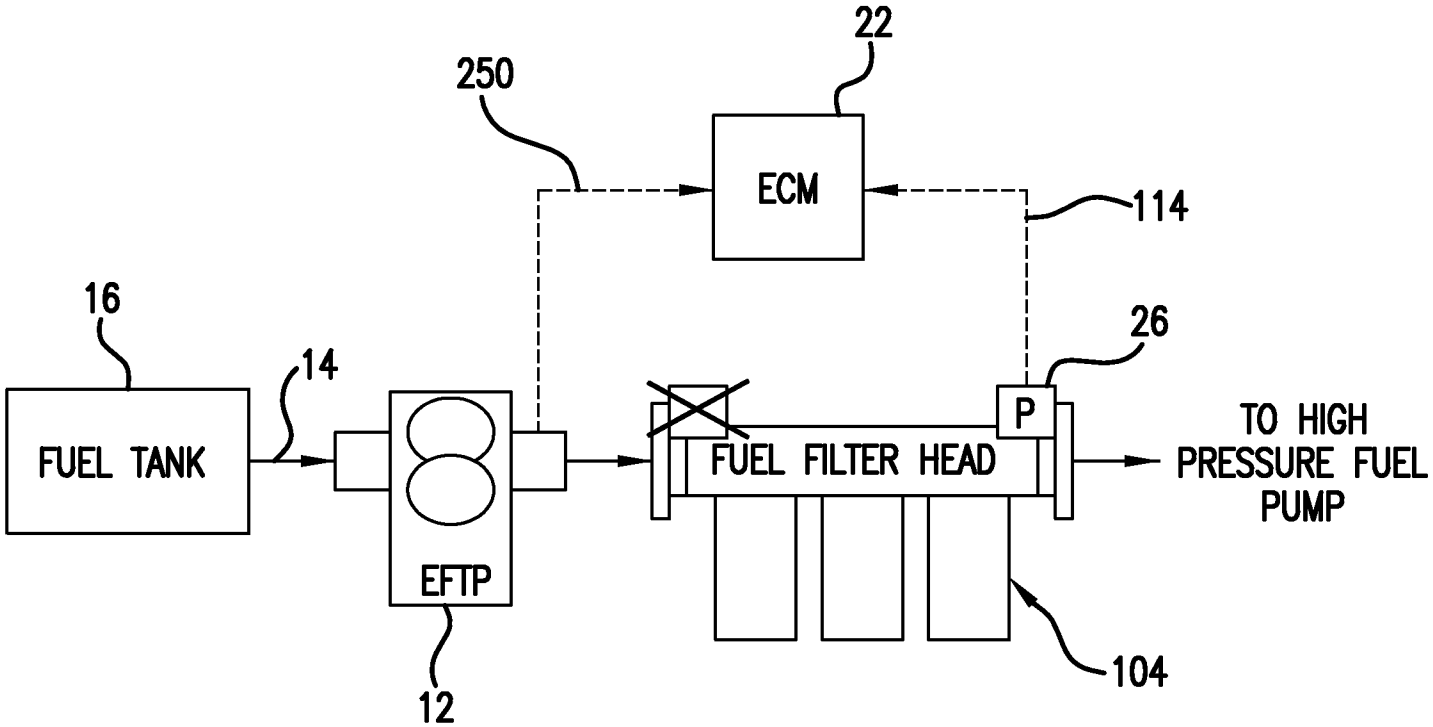
FIG. 4 is a schematic showing a filter load sensing system for a filter positioned downstream of the transfer pump.

Referring to FIG. 4, a system and method for detecting fuel filter loading of filter elements in second stage filter assembly 104, and thus the need for filter element changing, is also provided. As the fuel filter removes debris from the fuel, pores in the filter element get clogged. As pores clog, differential pressure across the fuel filter increases. This differential pressure is typically measured with pre-filter and post filter pressure sensors. However, since EFTP 12 draws current for operation, the current will vary as the downstream filter, e.g. second stage, gradually loads with particles. The fuel system includes post-filter downstream pressure sensor 26 which is used as input to determine control of the current to EFTP 12 by supplying the diagnostic signal 114 (equal to supply pressure feedback signal 28). EFTP 12 itself then can be used as a "virtual" pre-filter pressure sensor as EFTP current draw depends on, and correlates with, pre-filter fuel pressure thereby replacing the conventional pressure sensor upstream of the filter which is shown crossed out in FIG. 4. The EFTP current draw is self-monitored and reported to ECM 22. Thus ECM 22 monitors the downstream pressure from the downstream sensor and uses that sensor reading in combination with the current draw information, obtained by signal 250, to determine and indicate, for example, the degree of filter element clogging and/or the need for fuel filter element replacement. The greater the current draw or level used by EFTP 12, the greater the amount of loading or accumulated debris in the filter. That is, an increase in filter element loading will cause an increase in current required to achieve the same flow rate. ECM 22 may provide an indication of the amount of filter loading based on the current draw and downstream pressure, and/or may alert the operator using a visual or audible alert when a predetermined loading level is reached. Of course the virtual sensor using current draw as an input as disclosed in FIG. 4 may be used in combination with any of the embodiments of FIGS. 1-3.

Figure 5:
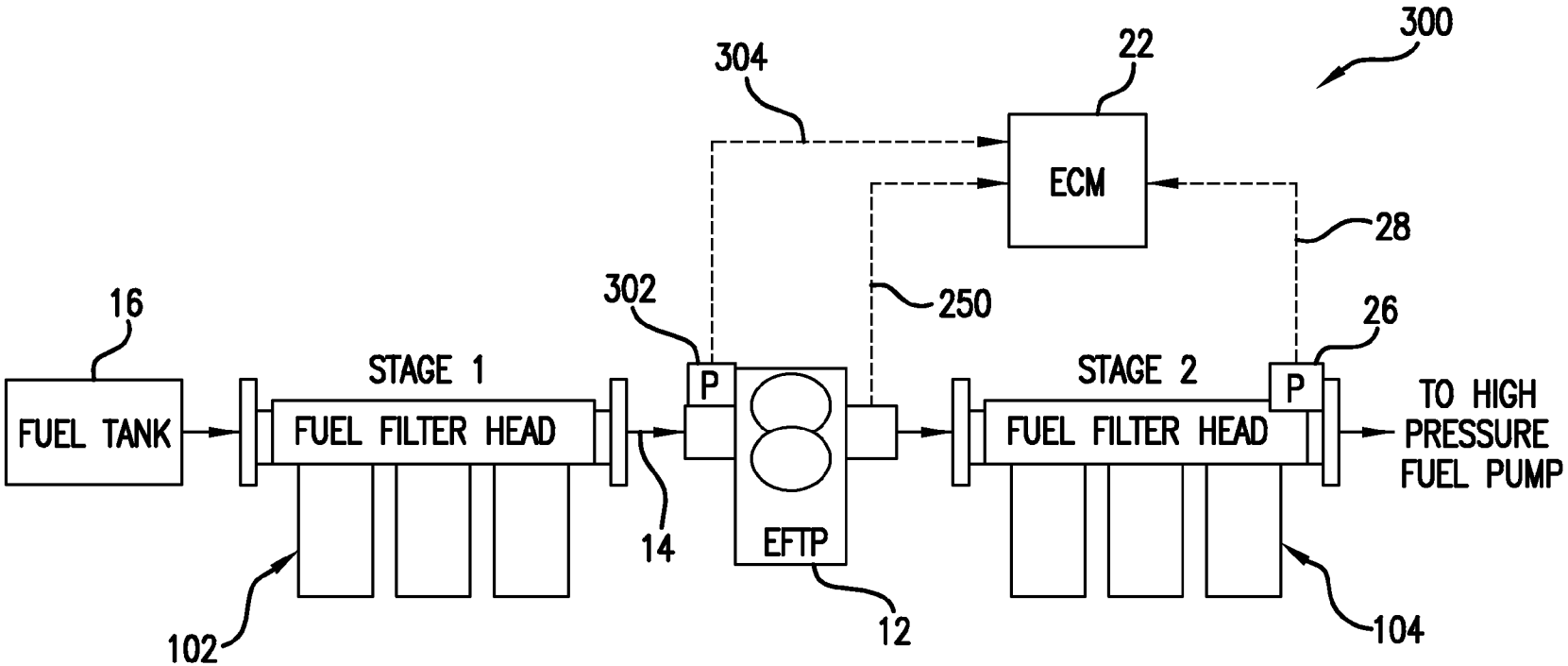
FIG. 5 is a schematic showing a filter load sensing system for a filter positioned upstream of the transfer pump.

As shown in FIG. 5, in addition to the virtual sensor that determines when the filter elements of second stage filter assembly 104 should be changed, the system 300 may also include an upstream filter load detecting system including an inlet absolute pressure sensor 302 mounted internally to EFTP 12 at the fuel inlet of EFTP 12. Inlet absolute pressure sensor 302 is used to determine the absolute pressure at the inlet of EFTP 12 after first stage filtration which in turn is used to determine when the filter elements of first stage filter assembly 102 should be changed/replaced. Monitoring absolute fuel pressure (under vacuum with respect to atmospheric pressure) at the EFTP inlet is important to ensure the fuel does not reach the vaporization pressure allowing vapor to form and increasing the chances of cavitation in EFTP 12, high pressure pump 20, and injectors 106. The addition of absolute fuel pressure sensor 302 at the inlet of EFTP 12 permits monitoring absolute fuel pressure (under vacuum with respect to atmospheric pressure) and ensures the fuel does not become vapor and contribute to cavitation. Other systems use delta P pressure sensors that monitor the pressure drop across first stage filtration. This is not as effective as monitoring the absolute fuel pressure since changes in ambient air pressure will not change the values of the pressure drop detected by fuel pressure (delta P) sensors. Changes in ambient air pressure are included when absolute fuel pressure is monitored. Using an absolute fuel pressure sensor will include the effects of ambient air pressure and ensure that vapor does not form before the EFTP under any conditions and thus greatly reduce the chances of cavitation in the fuel system components.

The addition of the absolute fuel pressure sensor 302 at the inlet of EFTP 12 also does not require any modification to the engine's wiring harness as well as not requiring an additional pressure sensor be mounted to the first stage fuel filter head. The existing communication system between EFTP 12 and the engine's ECM 22 is utilized. EFTP 12 monitors the absolute fuel pressure at the inlet of EFTP 12. When the absolute fuel pressure reaches a predetermined value (set higher than the vaporization pressure of fuel, e.g. diesel fuel), EFTP 12 sends a signal 304 to ECM 22 so that it may alert the operator using a visual or audible alert that it is time to change first stage fuel filtration. Of course the filter load sensing system of FIG. 5 using an absolute pressure sensor may be used in combination with any of the embodiments of FIGS. 1-4.

Figure 6:
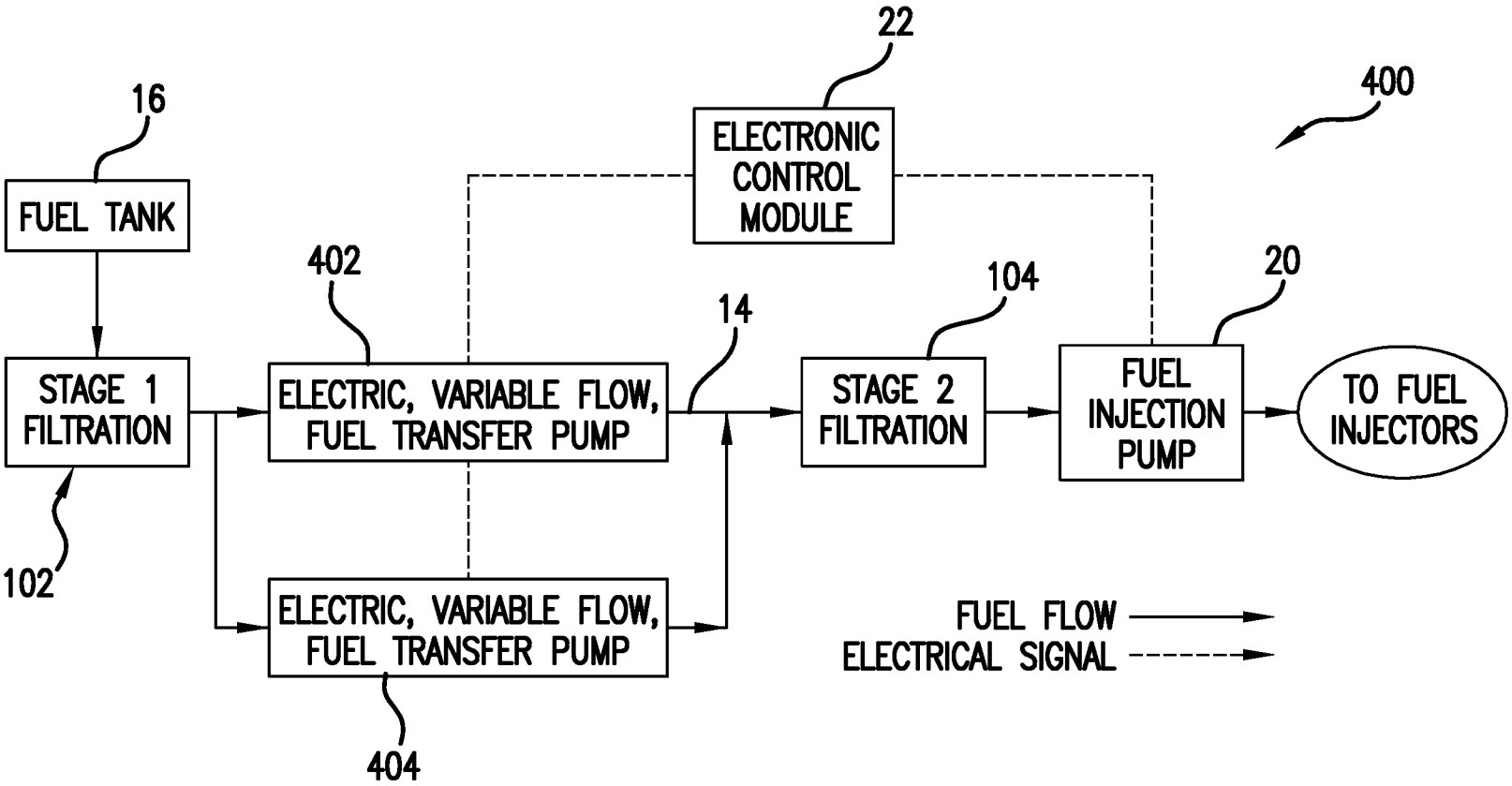
FIG. 6 is a schematic of another fuel system in accordance with a third exemplary embodiment including dual variable flow electric fuel transfer pumps.

In another exemplary embodiment shown in FIG. 6, a system 400 and method includes two or more electric, variable flow, fuel transfer pumps plumbed or positioned in parallel fuel flow paths in between the first stage suction filtration and second stage pressurized filtration in the low pressure fuel system of an internal combustion engine. In the exemplary embodiment, a first EFTP 402 and a second EFTP 404 are used. The fuel flow from EFTPs 402, 404 would be controlled by ECM 22 and the respective EFTP controllers in the manner described relative to any one of the embodiments of FIGS. 1-3 so that the total combined flow from EFTPs 402, 404 matches the flow commanded by the ECM to the high pressure fuel injection pump 20. Each variable flow, electric fuel transfer pump 402, 404 would be sized to singularly meet the needs of the engine flow at rated level but would only deliver 1/n of the total fuel flow required during normal operation (n=number of pumps). Having multiple fuel transfer pumps allows redundancy. In the event one of the EFTPs 402, 404 were to fail, the other pump(s) would increase fuel delivery to 1/(n−1) to meet the demands of the high pressure fuel injection pump 20. Controlling the fuel flow to only the amount required by the high pressure fuel injection pump 20 ensures no decrease in fuel filtration life from excessive fuel flow that would occur if the EFTPs did not have provisions for variable fuel flow to only that required by the high pressure fuel injection pump.

As mentioned, having multiple variable speed/flow, electric fuel transfer pumps, each sized to singularly meet the flow requirements of the internal combustion engine allow redundancy if one or more of the fuel transfer pumps would fail. The fuel flow of each variable flow, electric fuel transfer pump is described below.

Percentage of Flow per Fuel Transfer Pump during normal operation:

n=total number of fuel transfer pumps

Percentage of fuel delivery per pump=1/n

Percentage of Flow per Fuel Transfer pump when one or more pumps fail:

n=total number of fuel transfer pumps x=number of failed fuel transfer pumps

Percentage of Fuel Delivery per operating pump=1/(n−x)

Engine continues to operate as normal as long as n>x

Thus, the systems and methods described herein offer many advantages and benefits including minimizing the fuel flow through the second stage filtration since only that fuel required to attain the necessary power level (e.g. injected fuel+minimally recirculated fuel flow for cooling) is pumped by the fuel transfer pump. Since absolute flow rates values are much lower than that of mechanically-driven pump systems, flow surge effects are reduced due to minimizing difference between idle and rated fuel flow conditions. Closed-loop pressure-out control of the EFTP ensures the minimum required fuel flow is passing through the second (or primary) stage of the fuel filtration system, hence maximizing steady state fuel filtration efficiency, and minimizing surge effects on filtration efficiency. The control method (algorithm) and system allows flow rate change through the second stage of filtration to occur more gradually during engine performance conditions changes (e.g. idle-to-rated flow conditions or vice-versa) through pressure-out control of EFTP flow. Ultimately, improved injector life (durability) and improved injector reliability (B-life) is achieved, especially at elevated injection pressures. Thus, the engine may be operated at higher injection pressures with lower risk of debris-related fuel system component issues. In addition, the system avoids a mechanical fuel transfer pump thereby allowing one less mechanical drive provision on the internal combustion engine and avoids using a non-variable flow electric fuel transfer pump thereby ensuring only the minimum amount of electrical current is pulled from the electrical charging system as excessive flow and thus excessive current is minimized.

Many aspects of the disclosure are described in terms of sequences of actions to be performed by elements of a computer system or other hardware capable of executing programmed instructions. It will be recognized that in each of the embodiments, the various actions could be performed by specialized circuits (e.g., discrete logic gates interconnected to perform a specialized function), by program instructions (software), such as program modules, being executed by one or more processors, or by a combination of both. Moreover, the disclosure can additionally be considered to be embodied within any form of computer readable carrier, such as solid-state memory, magnetic disk, and optical disk containing an appropriate set of computer instructions, such as program modules, and data structures that would cause a processor to carry out the techniques described herein. A computer-readable medium would include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (EPROM or Flash memory), or any other medium capable of storing information. Thus, the various aspects of the disclosure may be embodied in many different forms, and all such forms are contemplated to be within the scope of the disclosure.

While various embodiments in accordance with the present disclosure have been shown and described, it is understood that the disclosure is not limited thereto. The present disclosure may be changed, modified and further applied by those skilled in the art. Therefore, this disclosure is not limited to the detail shown and described previously, but also includes all such changes and modifications.

We claim:

1. A fuel system for an internal combustion engine, comprising:

a fuel supply circuit;

a high pressure pump positioned along said fuel supply circuit;

a variable speed electric fuel transfer pump positioned along said fuel supply circuit upstream of said high pressure pump; and an electronic control device adapted to generate a feed forward command signal based on fuel demand of the engine to control a speed of said variable speed electric fuel transfer pump.

2. The fuel system of claim 1, wherein said electronic control device determines the engine fuel demand based on at least one engine operating condition and generates an injection control signal corresponding to said engine fuel demand, said electronic control device adapted to generate the feed forward command signal based on at least one of the engine fuel demand and changes in the engine fuel demand.

3. The fuel system of claim 2, wherein said electronic control device determines a high pressure target value for said high pressure pump based on at least one engine operating condition and generates a pressure control signal, said electronic control device adapted to generate said feed forward command signal based on at least one of said high pressure target value and changes in said high pressure target value.

4. The fuel system of claim 1, further including a high pressure sensor to detect high fuel pressure generated by the high pressure pump and to generate a high pressure feedback signal, said electronic control device adapted to generate said feed forward command signal based on said high pressure feedback signal.

5. The fuel system of claim 1, wherein said variable speed electric fuel transfer pump includes a pump controller, further including a low pressure sensor positioned along said fuel supply circuit downstream of said variable speed electric fuel transfer pump and connected to said pump controller to deliver a supply pressure signal to said pump controller.

6. The fuel system of claim 5, wherein said pump controller is adapted to control the speed of said variable speed electric fuel transfer pump in a feed forward closed loop mode to control a speed of said variable speed electric fuel transfer pump based on the feed forward command signal and said supply pressure signal.

7. The fuel system of claim 6, wherein said pump controller is adapted to control the speed of said variable speed electric fuel transfer pump in a supply pressure closed loop mode based only on said supply pressure signal.

8. The fuel system of claim 7, wherein said pump controller is adapted to control the speed of said variable speed electric fuel transfer pump in a feed forward open loop mode based only on said feed forward command signal.

9. The fuel system of claim 6, wherein said pump controller is adapted to control the speed of said variable speed electric fuel transfer pump in a feed forward open loop mode based only on said feed forward command signal.

10. The fuel system of claim 1, further including a downstream filter assembly positioned along the supply circuit downstream of said variable speed electric fuel transfer pump and a pressure sensor positioned along said supply circuit downstream of said filter assembly to supply a downstream pressure signal to said electronic control device, further including a downstream filter load detecting system including said electronic control device being adapted to monitor a current supplied to said variable speed electric fuel transfer pump and determine a filter load condition based on said current and said downstream pressure signal.

11. The fuel system of claim 1, further including an upstream filter load detecting system including an inlet absolute pressure sensor mounted at a fuel inlet to said variable speed electric fuel transfer pump to measure an absolute pressure, and a pump controller adapted to monitor the absolute pressure from said inlet absolute pressure sensor and generate a signal indicating filter loading when the absolute pressure reaches a predetermined value.

12. The fuel system of claim 1, further including another variable speed fuel electric transfer pump positioned along said supply circuit in a parallel flow path to said variable speed electric fuel transfer pump, each of said variable speed electric fuel transfer pumps having a pumping capacity sufficient to supply a total fuel flow to said high pressure pump.

13. The fuel system of claim 1, where said high pressure pump generates a high pressure fuel flow rate corresponding to the fuel demand of the engine, said variable speed electric fuel transfer pump including a pump controller controlling said variable speed electric fuel transfer pump based on said feed forward command signal to cause a low pressure flow rate from said variable speed electric fuel transfer pump to vary in direct proportion to said high pressure fuel flow rate throughout engine operation.

14. A method for controlling a flow of fuel in an internal combustion engine, comprising:

providing a fuel supply circuit;

transferring fuel along said fuel supply circuit at a supply pressure and a supply fuel flow rate;

providing a variable speed electric fuel transfer pump and high pressure pump positioned along said fuel supply circuit to pressurize supply fuel to a high pressure level and provide high pressure fuel at a high pressure flow rate;

controlling the variable speed electric fuel transfer pump to vary the supply fuel flow rate of supply fuel to said high pressure pump in direct proportion to changes in said high pressure fuel flow rate and independent of engine speed.

15. The method of claim 14, wherein said supply fuel flow rate is controlled based on engine fuel demand to approximate the high pressure flow rate.

16. The method of claim 14, wherein said supply fuel flow rate is controlled based a target fuel injection amount and a target high pressure value.

17. The method of claim 14, further including generating a feed forward command signal based on engine fuel demand, generating a supply feedback pressure signal based on said supply pressure, and controlling the supply fuel flow rate based on said feed forward command signal and said supply feedback pressure signal.

18. A fuel system for an internal combustion engine, comprising:

a fuel supply circuit;

a variable flow fuel transfer pump positioned along said fuel supply circuit and adapted to variably control a low pressure fuel flow rate from said variable flow fuel transfer pump;

wherein said variable flow fuel transfer pump is adapted to operate in a feed forward closed loop mode to control the low pressure fuel flow rate from said variable flow fuel transfer pump based on engine fuel demand and a supply pressure of the low pressure fuel flow rate.

19. The system of claim 18, wherein said variable flow fuel transfer pump is further adapted to operate in a feed forward open loop mode to control the low pressure fuel flow rate from said variable flow fuel transfer pump based only on engine fuel demand.

20. The system of claim 18, wherein said variable flow fuel transfer pump is further adapted to operate in a supply pressure closed loop mode to control the low pressure fuel flow rate from said variable flow fuel transfer pump based only on the supply pressure of the low pressure fuel flow rate.

* * * * *